US011607721B2

(12) United States Patent
Otto et al.

(10) Patent No.: US 11,607,721 B2
(45) Date of Patent: Mar. 21, 2023

(54) METHOD FOR PRODUCING A MODEL MOLD CORE BLANK AND A PRECISION CASTING MOLD, AND A CASTING METHOD FOR PRODUCING A CAST PART HAVING A VOID STRUCTURE

(71) Applicant: Johannes + Michael Otto GbR, Bad Endbach (DE)

(72) Inventors: Johannes Otto, Bad Endbach (DE); Michael Otto, Bad Endbach (DE)

(73) Assignee: Johannes + Michael Otto GbR, Bad Endbach (DE)

( * ) Notice: Subject to any disclaimer, the term of this patent is extended or adjusted under 35 U.S.C. 154(b) by 0 days.

(21) Appl. No.: 17/269,022

(22) PCT Filed: Aug. 20, 2019

(86) PCT No.: PCT/EP2019/072308
§ 371 (c)(1),
(2) Date: Feb. 17, 2021

(87) PCT Pub. No.: WO2020/048774
PCT Pub. Date: Mar. 12, 2020

(65) Prior Publication Data

US 2021/0323049 A1 Oct. 21, 2021

(30) Foreign Application Priority Data

Sep. 3, 2018 (EP) ..... 18192272

(51) Int. Cl.
*B22C 7/02* (2006.01)
*B22C 9/10* (2006.01)

(52) U.S. Cl.
CPC . *B22C 7/02* (2013.01); *B22C 9/10* (2013.01)

(58) Field of Classification Search
CPC ..... B22C 7/02; B22C 9/10; B22C 9/18
(Continued)

(56) References Cited

U.S. PATENT DOCUMENTS

2017/0326634 A1* 11/2017 Lowth et al. ..... B22C 9/04
2018/0147622 A1 5/2018 Balduini

FOREIGN PATENT DOCUMENTS

CN 105 945 220 9/2016
EP 3 251 790 12/2017
(Continued)

*Primary Examiner* — Kevin P Kerns
(74) *Attorney, Agent, or Firm* — Clark & Brody LP

(57) ABSTRACT

A method for producing a model mould core blank uses a ceramic blank fixed to a processing holder. During fixing, a lost core is manufactured from the ceramic blank based on a CNC manufacturing process 3D model, the processing holder being fastened in the running CNC machine. A model blank is produced by casting model material around the lost core while fixing persists. The model blank becomes part of another method for producing a model mould core, wherein an outer contour of a lost model is produced from and/or on the model blank on the basis of a second CNC manufacturing process 3D model, wherein fixing and processing holder fastening also occurs. Another method produces a precision casting mould, in which a ceramic mould is applied to the outer contour of the lost model, and a cast part having a hollow cavity structure is produced by the precision casting mould.

22 Claims, 8 Drawing Sheets

(58) Field of Classification Search
USPC ..... 164/6, 15, 17, 45, 516
See application file for complete search history.

(56) References Cited

FOREIGN PATENT DOCUMENTS

| | | |
|---|---|---|
| EP | 3 616 806 | 3/2020 |
| JP | 2016-532567 | 10/2016 |
| WO | 2015/051916 | 4/2015 |

* cited by examiner

METHOD FOR PRODUCING A MODEL MOLD CORE BLANK AND A PRECISION CASTING MOLD, AND A CASTING METHOD FOR PRODUCING A CAST PART HAVING A VOID STRUCTURE

The invention relates to a method for producing a model mold core blank, to a method for producing a model mold core, to a method for producing a precision casting mold, and to a casting method for producing a cast part having a void structure.

Casting methods for producing components are known from the prior art. In these casting methods, a casting mold is filled with a material and removed after said material has hardened or solidified. Particular challenges arise when forming undercuts on the component and void structures in the component.

Components which are complex in terms of casting technology are therefore produced by what is known as precision casting, in which lost models and lost casting molds are used to produce the component. After completion of the precision casting process, both the model of the component and the casting mold are destroyed.

The model can for example be produced from wax and serve to create a casting mold composed of a ceramic. The casting mold is designed in particular as a lost mold in the form of a single-use ceramic coating of the model. After the wax is removed from the casting mold, a cavity remains, which can be filled with the material of the component to be produced. After the filling and hardening operations, the casting mold is destroyed and the component removed.

In order to be able to form void structures in the component, cores are used, around which the wax model is manufactured. These cores remain in the cavity of the ceramic coating after the wax is removed from the ceramic coating and then correspondingly also form a cavity in the component. The core is removed from the component later by mechanical or chemical processes.

In particular for the production of turbine blades, WO 2015/051916 A1 describes a method in which firstly a core is produced in accordance with a 3D model in a first CNC process. The core is subsequently positioned in a processing mount in order to then be covered with a wax body blank. To some extent, this involves a method for producing a model mold core blank.

After this, the wax body blank is processed in a second CNC process in such a way that a lost model of the component composed of wax forms around the core. Thus far, the method can be referred to as a method for producing a model mold core. The model mold core produced in this way thus comprises a lost core and the lost model.

A disadvantage of the methods for producing the model mold core blank and the model mold core is that the position of the core relative to the lost model is not achieved reliably in terms of the process to sufficient precision. This results in waste. The later the erroneous positioning of the core, which can scarcely be ascertained from the outside, is detected in the lost model, the higher are the costs of the waste. In the various manufacturing stages, considerable effort must therefore be expended to prevent positional misplacements of the void structures in the final component.

The steps performed in the method of WO 2015/051916 A1 can no longer compensate for the positional misplacement of the core arising up to the production of the model mold core. According to the method, specifically immediately afterwards a ceramic mold is applied to the lost model. In order that the ceramic mold is still positioned relative to the core even after the lost model is removed, the ceramic mold is connected beforehand to the processing mount on which the core has also been positioned and fixed. The method carried out thus far is thus a method for producing a precision casting mold.

A disadvantage of this precision casting mold is that an expensive processing mount which withstands later firing processes and the metal casting is necessary. Moreover, it is possible that there is a positional misplacement of the lost core in the ceramic mold, which makes either the precision casting mold as such or the subsequently cast component unusable.

The method according to WO 2015/051916 A1 finally includes an operation of filling the ceramic mold having the inner core with molten metal, while the lost core and the ceramic casing are also connected to the processing mount. After the metal has solidified to form a solid component, the ceramic mold and the core are removed.

A disadvantage of this work step is that the processing mount is exposed to the casting temperatures of the metal. The processing mount can deform in the process, with the result that the relative positioning between the ceramic mold and the core changes. Moreover, the processing mount has to consist of materials which are resistant to high temperatures, which makes said processing mount expensive and entails increased complexity when being accommodated in machine tools.

It is therefore an object of the invention to develop method steps which contribute to a positioning of a lost core relative to a ceramic mold of a precision casting mold that is reliable in terms of process, reproducible and above all accurate, wherein it should be possible to carry out the method steps quickly, inexpensively and with a complexity which is as low as possible. The intention in particular is that waste from the production of the core up to the finished component is also prevented in this way.

The invention relates to a method for producing a model mold core blank, which is suitable in particular for producing a cast part having a void structure, using a 3D model (three-dimensional model) with the digital geometrical coordinates of the cast part. In this method, a ceramic blank is positioned on a processing mount and a fixing is produced between the ceramic blank and the processing mount. The cubature of the ceramic blank is preferably greater than a core element to be produced therefrom. A core element is subsequently produced, wherein a lost core is manufactured from the ceramic blank on the basis of the 3D model in a first CNC production process while the fixing persists, wherein the processing mount is fixed in a CNC machine for carrying out the first CNC production process. The lost core is preferably a void model of the void structure. After this, the method provides producing a model blank by casting modelling material around the lost core and allowing the modelling material to solidify while the fixing persists. In this respect, when the outer contour of the lost model is produced by a material-removing method, such as for example turning, milling, laser cutting etc., the cubature of the model blank is preferably greater than a lost model to be produced therefrom, wherein the lost model is preferably a positive model of the cast part. Conversely, when the outer contour of the lost model is produced on the model blank by a material-depositing method, such as for example 3D printing, the cubature of the model blank is preferably smaller than a lost model to be produced therefrom, wherein the lost model is preferably a positive model of the cast part.

An advantage of the method according to the invention is that the lost core has a defined position relative to the processing mount. This avoids positioning problems which might otherwise occur due to subsequent fixing of an already produced core element having a lost core to a processing mount. Any clamping of a core element in a processing mount can specifically result in stress deformations of the core element. The alternative production of a fixing by adhesive bonding takes a long time and hardening stresses in the adhesive can likewise result in positional deviations between the core element and the processing mount. Even small deviations in the region of the fixing can lead to greater positional deviations away from the fixing. All of this is avoided according to the invention.

A machining process, in particular a milling process, and/or a generative manufacturing process such as for example 3D printing or selective laser melting or sintering can be used as first CNC production process. The preferred process is the milling process.

As an alternative to the method step "producing a model blank by casting modelling material around the lost core and allowing the modelling material to solidify while the fixing persists", a 3D printing process can also be provided, in which a modelling material, e.g. wax, is printed onto and/or around the lost core while the fixing persists. Such 3D printing processes permit particularly complex geometries. By way of such material-depositing processes, either the model blank can be produced, or else the entire outer contour of the lost model or at least parts of the outer contour of the lost model is/are produced directly.

According to an optional addition to the method, provision can be made that the processing mount is positioned before the first CNC production process is carried out and before the processing mount is fixed in the CNC machine carrying out the process. An advantage of this is that the processing mounts can be connected to the ceramic blank away from the CNC machine. This reduces the machine downtimes, in particular when a plurality of processing mounts have a homogeneous geometry.

In a special method variant, the processing mount has a coupling piece for accommodation in a zero point fixing system, wherein, when carrying out the first CNC production process, the coupling piece is accommodated in a zero point fixing system of the CNC machine carrying out the process. In this way, fast changeovers of processing mounts in the CNC machine with simultaneously high positioning precision are possible. A zero point fixing system is distinguished in particular in that exact positioning is not necessary when the fixing is being produced. The coupling piece has to be positioned only roughly and the coupling piece is then aligned in the zero point fixing system automatically during the fixing operation. In particular, defined correlating positioning surfaces contribute to the correct positioning in a zero point fixing system, in particular both on sides of the coupling piece and on sides of the zero point fixing system.

Zero point fixing systems in the context of this document are to be understood as meaning zero point clamping systems and other holding mechanisms (adhesion, adhesive bonding, negative pressure, etc.) Zero point clamping systems fix by means of clamping forces. Zero point clamping systems can also be combined with other holding mechanisms, with the result that clamping forces and other holding forces are exploited for the purpose of fixing.

The method can be supplemented in that a stabilizing frame is produced from the ceramic blank during the first CNC production process and while the fixing persists, wherein the stabilizing frame supports the lost core, which is arranged in particular on at least one supporting point which is spaced apart from the processing mount. Stabilizing frames of this type make it possible to provide very precise lost cores which are not deformed or damaged either during the dedicated production thereof or during subsequent manufacturing steps. The stabilizing frame can lie at least partially outside the model blank. In this region, it then disrupts further processing of the model blank to a relatively small extent.

In a particular method variant, one or more supporting points between the stabilizing frame and the lost core are removed after the production of the lost core and before the model blank is produced, this preferably taking place in the first CNC production process. In this way, the lost core is kept stable during the processing in the first CNC production process and it is possible to form particularly precise contours on the lost core. The supporting points are preferably connecting webs, which are preferably narrower and/or thinner than the adjoining region of the lost core.

The stabilizing frame is optionally removed after the production of the lost core and before the model blank is produced, preferably after one or more supporting points have been removed, and further preferably in the first CNC production process. This is suitable in particular for lost cores which have sufficient intrinsic stability.

In another variant, the stabilizing frame is not removed before the model blank is produced. The stabilizing frame can then support the lost core also during the production of the model blank and optionally also the production of the lost model. In this respect, the stabilizing frame can be arranged at least partially in the model blank. However, it should lie outside the lost model. Supporting points of the stabilizing frame can then protrude through the lost model as far as the lost core. In this way, even lost cores with an unstable configuration are stabilized during the further method steps, dimensional changes are avoided and damage is prevented.

A modelling wax is particularly suitable as modelling material. The modelling material should have a lower melting temperature than the core element.

According to a special method configuration, a sprue model is formed during the production of the model blank. Such a sprue model will later form a sprue in a ceramic precision casting mold during the production of the ceramic precision casting mold. At the same time, it can be used as an outlet to remove the lost model and/or the lost core. The sprue model is optionally conical. In that case, the result is a funnel-shaped sprue.

In this application, the abbreviation CNC stands for computer numerical control, or production steps which in particular are executed automatically by a computer.

The surfaces of the core element can optionally be coated after the first CNC production process. The surfaces can be formed as particularly smooth in this way.

To produce the model blank, the lost core can be arranged for example in a model molding tool and the model blank can be formed around the lost core in that modelling material such as wax, thermoplastic or the like is filled/injection molded into the space between the lost core and the inner walls of the model molding tool.

The ceramic blank can firstly be made into the desired blank shape by injection molding, transfer molding or casting of a suitable liquid of ceramic material. The starting material can comprise one or more ceramic powders, a binder and optionally additives, which can be introduced into a correspondingly formed blank molding tool. After the ceramic material has hardened to form a "green compact", the blank molding tool can be removed, e.g. opened, in order to remove the green compact. After the green compact has been removed from the blank molding tool, it should be fired in one or more steps at a high temperature in order to remove the volatile binder and to sinter and harden the ceramic blank. In this way, said green compact achieves a strength and dimensional accuracy which are sufficient for use in the casting of metallic material, such as for example a titanium-based, nickel-based or cobalt-based alloy.

As an introductory method step, it is optionally possible to adapt the 3D model with the digital geometrical coordinates of the cast part in order to take into consideration a correction of manufacturing-related dimensional deviations due to, for example, shrinkage or material stresses.

The invention also includes a model mold core blank, which is produced by a method for producing a model mold core blank, as described above and below. The advantages of the method are also inherent to the model mold core blank. In particular, said model mold core blank can be produced with high precision, with process reliability and inexpensively.

The invention also relates to a method for producing a model mold core, in which the method for producing a model mold core blank, as described above and below, is carried out, and which comprises producing an outer contour of a lost model from and/or on the model blank on the basis of the 3D model in a second CNC production process while the fixing persists, wherein the processing mount is fixed in a CNC machine for carrying out the second CNC production process.

An advantage of this is that the lost core assumes a defined position on the processing mount and consequently the lost model is also formed such that it is positioned correctly relative to the processing mount and thus also to the lost core.

For this purpose, according to the method, the processing mount is preferably positioned before the second CNC production process is carried out and before the processing mount is fixed in the CNC machine carrying out the process. Processing mounts with a defined geometry can be positioned particularly easily, quickly and precisely in the CNC machine(s) carrying out the process. It is possible for this CNC machine to be released and used in another way when carrying out method steps for which a CNC machine is not required.

In a particularly preferred method configuration, the processing mount has a coupling piece for accommodation in a zero point fixing system, wherein, when carrying out the second CNC production process, the coupling piece is accommodated in a zero point fixing system of the CNC machine carrying out the process. This enables the processing mount to be accommodated particularly precisely and quickly in the CNC machine.

The first CNC production process is preferably a material-removing process, further preferably a machining process, and particularly preferably a milling process.

The second CNC production process is preferably either a material-removing process, further preferably a machining process, and particularly preferably a milling process, or a material-depositing process such as 3D printing. The second CNC production process can also combine material-removing and -depositing processes. In this way, it is possible to produce different regions of the lost model in a particularly efficient manner.

The optional stabilizing frame can lie at least partially outside the lost model. Said stabilizing frame then has, at least in part, no contouring influence on the component which is to be created later and is based in particular on the positive body of the lost model.

The subject matter of the invention also includes a model mold core, which is produced by the method for producing a model mold core, as described above and below. The advantages of the method are also inherent to the model mold core. In particular, said model mold core can be produced with high precision, with process reliability and inexpensively.

Furthermore, the invention relates to a method for producing a precision casting mold, in which the method for producing a model mold core, as described above and below, is carried out. In this method, a ceramic mold is applied to the outer contour of the lost model and a positioning connection of the ceramic mold to at least one attachment point is formed on the core element. Finally, the lost model is removed from the ceramic mold.

It is advantageous here that, by means of the positioning connection, the core element and the lost mold have a high relative positional accuracy with respect to one another. In this respect, the processing mount should not have any direct connection to the ceramic mold. This specifically allows said processing mount to be removed. In this respect, the positioning connection should be formed in such a way that the removal of the processing mount does not have any influence on the relative positioning between the ceramic mold and the lost core. In this way, an inexpensive processing mount can be used, which does not need to be able to withstand firing and/or sintering temperatures or casting temperatures during the creation of the component. Moreover, reusable processing mounts can be used, in particular also those which consist at least in parts or else completely of tool steel.

For this purpose, the method can optionally be supplemented by a step in which the fixing between the processing mount and the core element is removed and the core element is separated from the processing mount before or after the lost model is removed from the ceramic mold, i.e. in particular after applying the ceramic mold or after removing the lost model from the ceramic mold, and particularly preferably before carrying out a casting process for producing the cast part in the precision casting mold.

The ceramic mold can be applied to the outer contour of the lost model for example by virtue of repeated immersion into a ceramic slip, wherein, after each immersion, excess slip flows off and sanding with ceramic stucco and air drying take place. In this way, a plurality of ceramic layers which form the ceramic mold on the outer contour in the manner of a mold shell can be built up. The resulting arrangement can then be fed to a steam autoclave in order to remove the lost model, with the result that the ceramic mold with the lost core arranged therein remains as a precision casting mold.

The method can be supplemented by the optional step of firing the arrangement comprising the core element and the ceramic mold before or after separating the core element from the processing mount. In this way, volatile binder is removed and the arrangement is sintered and hardened. The precision casting mold produced in this way thereby achieves a strength and dimensional accuracy which are sufficient for use in the casting of metallic material, such as for example a titanium-based, nickel-based or cobalt-based alloy.

In one method variant, when producing the outer contour of the lost model from the model blank, a sprue model is also formed, in particular from the model blank. This step can comprise completely working-out the sprue model from the model blank or, if provided, the post-processing of a rougher sprue model already formed on the model blank. Such a sprue model will later form a sprue in a ceramic precision casting mold during the production of the ceramic precision casting mold. At the same time, the sprue can be used as an outlet to remove the lost model and/or the lost core. The sprue model is optionally conical. In that case, the result is a funnel-shaped sprue.

The subject matter of the invention also includes a precision casting mold, which is produced by the method for producing a precision casting mold, as described above and below. The advantages of the method are also inherent to the precision casting mold. In particular, said precision casting mold can be produced with high precision, with process reliability and inexpensively, wherein in particular the lost core is positioned and held correctly in the ceramic mold. Sprue structures and also ventilation structures for the casting process can then be attached to the precision casting mold. As an alternative, separate sprue structures and also ventilation structures for the later casting method can also be attached already to the lost model, such that said structures are then connected to or are part of the precision casting mold.

Moreover, the invention relates to a casting method for producing a cast part having a void structure, in which a method for producing a precision casting mold, as described above and below, is carried out, and in which molten metal is cast into the ceramic mold around the lost core, the molten metal is solidified to form a solid component, and the ceramic mold and the lost core are removed from the solid component. On the basis of the method, the solid component has void structures which are positioned very accurately in the solid component, with the result that for example there are no weak points which might make the solid component unusable. The lost core is in particular removed from the void structure of the component. The lost core is removed from the solid component preferably by water-based or chemical erosion or other techniques. If the core element also has an optional stabilizing frame, this is also removed from the solid component.

The casting method preferably comprises the optional step of removing the fixing between the processing mount and the core element and separating the core element from the processing mount at the latest before the molten metal is cast into the ceramic mold. In this way, an inexpensive processing mount can be used which at least does not need to withstand the casting temperatures of the molten metal.

The casting method is particularly suitable when the molten metal is a titanium-based, nickel-based or cobalt-based alloy. In the case of expensive components of this type, high cost savings can be achieved by the reduction of waste and component damage according to the method.

The precision casting mold is optionally preheated before the casting of the molten metal. This makes it possible to positively influence the crystal formation and to avoid cracks in the precision casting mold due to thermal stresses caused by sudden changes in temperature.

The molten metal solidifies preferably in a polycrystalline manner, and particularly preferably in a monocrystalline manner. A high component strength is achieved in this way.

Further features, details and advantages of the invention become apparent from the phrasing of the claims and from the following description of exemplary embodiments with reference to the drawings, in which:

FIGS. 1 to 7 show a possible chronological sequence of method results after carrying out various method steps. Technical features having reference signs about which statements have already been made in a preceding figure are to some extent not described again. Rather, the preceding parts of the description apply correspondingly.

Figure 1:
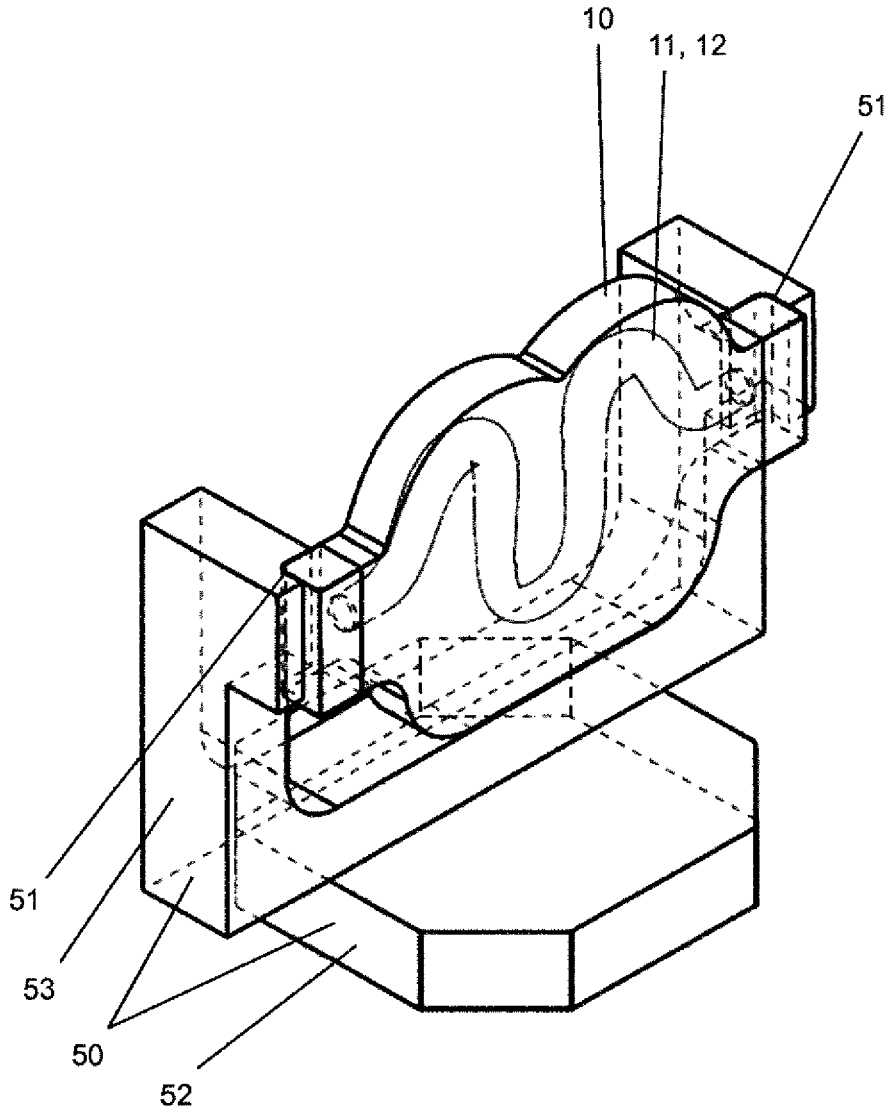
FIG. 1 shows a ceramic core blank on a processing mount.

Firstly, a ceramic core blank 10, which is fixed to a processing mount 50 via a fixing 51 on two sides, can be seen in FIG. 1. The fixing 51 can be formed for example by adhesive bonding or clamping. In the present case, the two sides of the fixing 51 are situated opposite one another and the ceramic core blank 10 is arranged between the two sides. In this respect, the processing mount 50 has a coupling piece 52 and a processing bridge 53. The processing bridge 53 extends between the two sides of the fixing 51 and is connected to or formed in a unipartite manner with the coupling piece 52. The coupling piece 52 is designed for accommodation in a zero point fixing system of CNC machine tools.

The cubature of the ceramic core blank 10 is preselected or prefabricated such that a core element 11 which has a lost core 12 and is to be produced from the ceramic core blank 10 by material removal lies within this cubature.

In this way, therefore, according to the method, it is necessary first to position the ceramic blank 10 on the processing mount 50 and to produce the fixing 51 between the ceramic blank 10 and the processing mount 50, in order to arrive at the method result according to FIG. 1.

Figure 2:
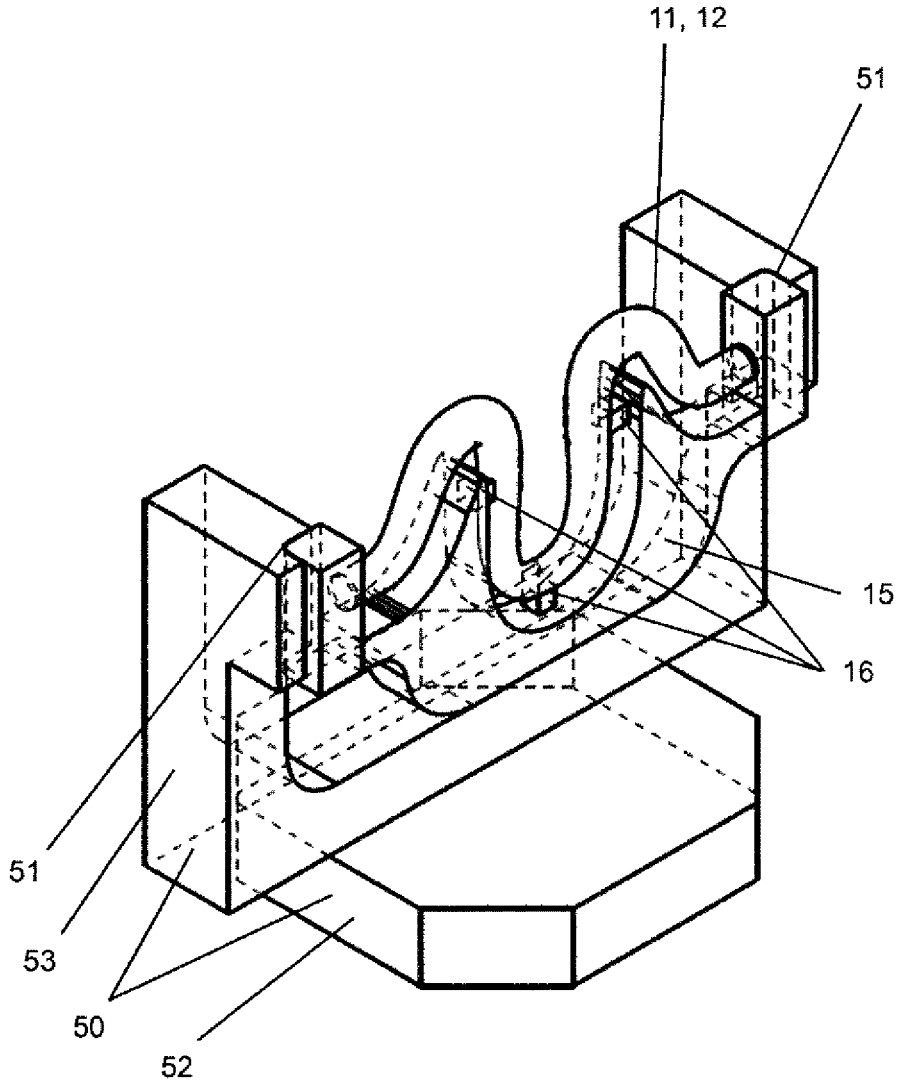
FIG. 2 shows a core element with a lost core and with a stabilizing frame on a processing mount.

FIG. 2 illustrates a possible outcome of the starting situation according to FIG. 1 after or during the production of the core element 11, wherein the lost core 12 is manufactured from the ceramic blank 10 (see FIG. 1) in accordance with a 3D model in a first CNC production process, for example a CNC milling process, while the fixing 51 persists. At the same time, a (temporary) stabilizing frame 15 is produced from the ceramic blank 10 (see FIG. 1) in the first CNC production process while the fixing 51 persists. The (temporary) stabilizing frame 15 supports the lost core 12 by way of supporting points 16. Each of the supporting points 16 is arranged spaced apart from the fixing 51. The supporting points 16 are connecting webs or pegs, each of which is narrower than the adjoining region of the lost core 12.

When carrying out the first CNC production process, the processing mount 50 is fixed to the coupling piece 52 in a CNC machine for the purpose of carrying out said first CNC production process.

Figure 3:
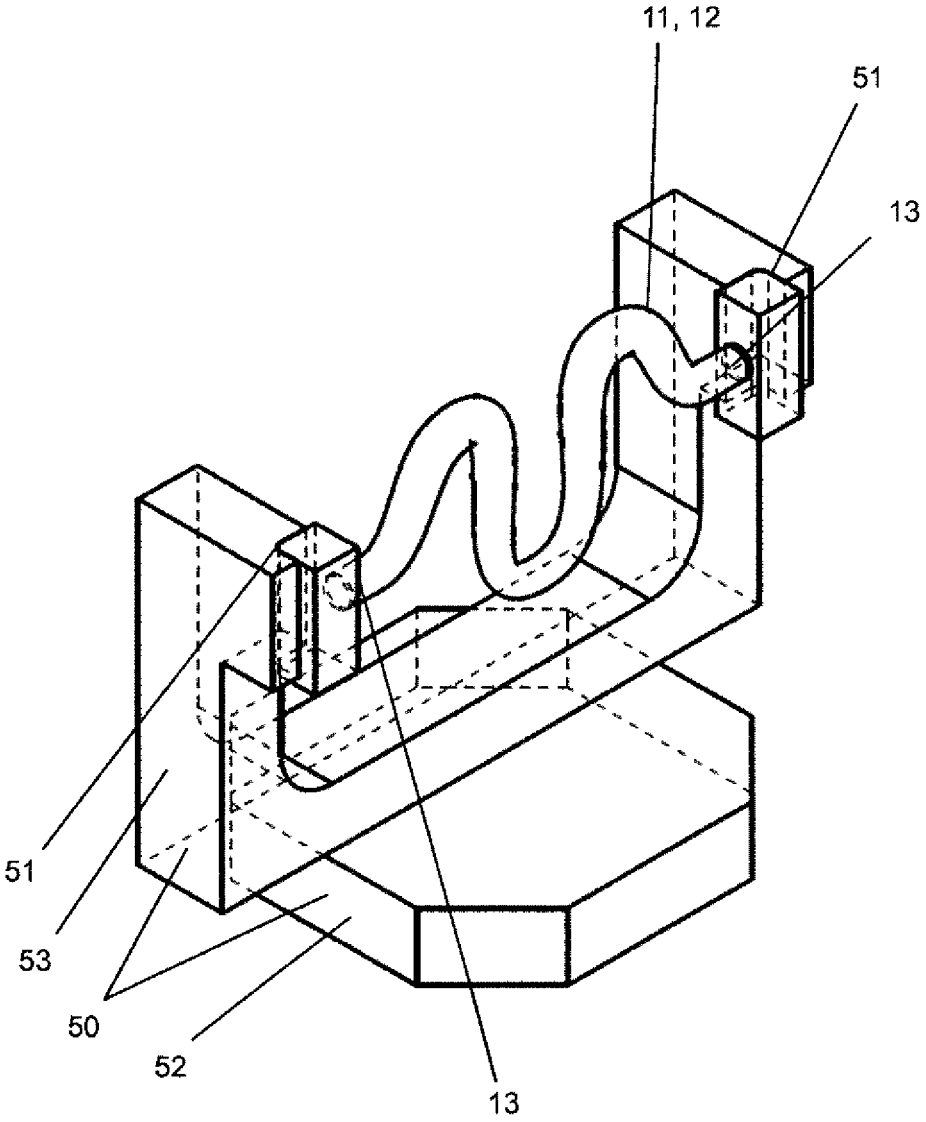
FIG. 3 shows a lost core on a processing mount.

After completion of the first CNC production process, according to FIG. 3 the lost core 12 of the core element 11 remains, said lost core extending between the two sides of the fixing 51. It can be seen that the stabilizing frame 15 has been removed after the production of the lost core 12, in particular after removing the supporting points 16.

The ceramic core blank 10 (see FIG. 1) has not been processed in the region of the fixing 51, in order not to weaken the fixing 51 and in order not to damage the processing mount 50. This unprocessed region of the ceramic core blank 10 (see FIG. 1) can also be referred to as fixing region. Already at this stage, the core element 11 also has two attachment points 13 to which later a ceramic mold 81 (see FIG. 7) is connected.

Figure 4:
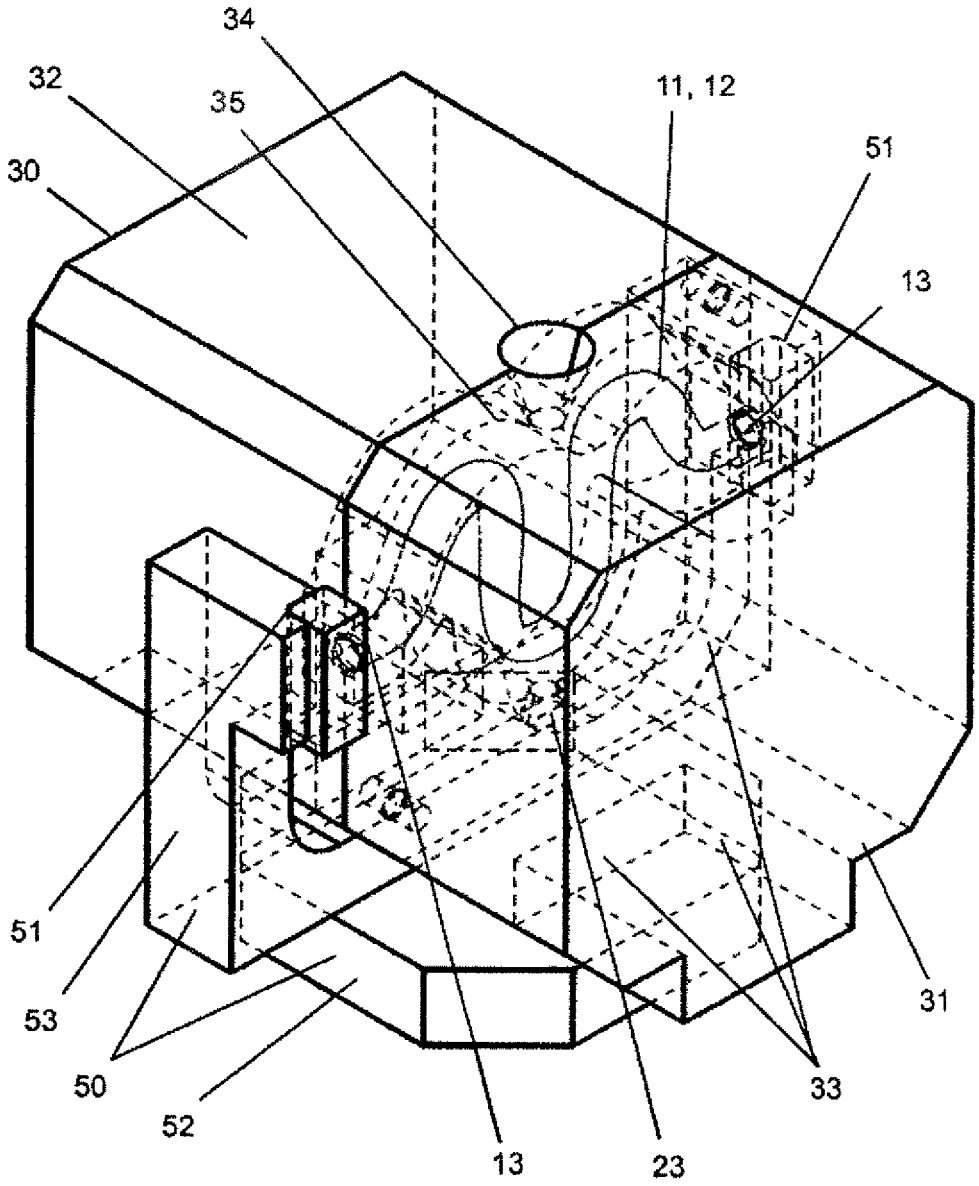
FIG. 4 shows a lost core on a processing mount, wherein the lost core is arranged in a two-part model molding tool for producing a model blank.
Figure 5:
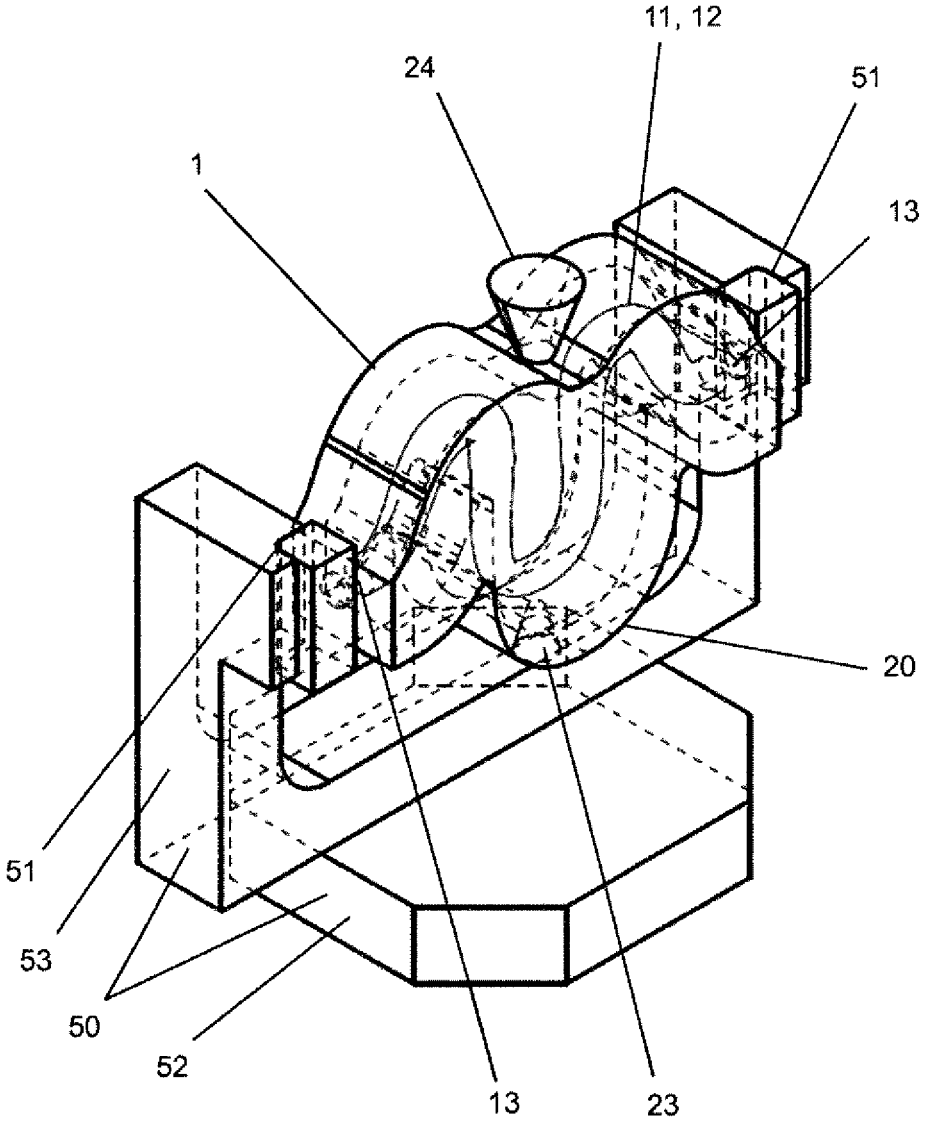
FIG. 5 shows a lost core on a processing mount, wherein the lost core is arranged in a model blank.

According to FIG. 4, the arrangement as per FIG. 3 is reused in such a way that the lost core 12 is also fixed to the processing mount 50 via the fixing 51 and is arranged in a model molding tool 30 for producing a model blank 20 (see FIG. 5). The model molding tool 30 has a first and a second mold half 31, 32 and is supported on the processing mount 50 via positioning surfaces 33, in particular on the coupling piece 52 and on the processing bridge 53. In the region of the attachment points 13, the core element 11 protrudes out of the model molding tool 30 through openings. In this way, a tool cavity 35 is formed around the lost core 11. A model sprue 34 which is formed by the model molding tool 30 opens out from above into this tool cavity 35.

The starting situation, shown according to FIG. 4, is now suitable for carrying out production of a model blank 20 (see FIG. 5) in that modelling material is cast through the model sprue 34 into the tool cavity 35, in particular i.e. around the lost core 12 lying in the tool cavity 35. The modelling material can be, for example, a modelling wax. The modelling material should have a lower melting temperature than the core element 11. The modelling material is then allowed to solidify. In the process, the fixing 51 continues to exist. The lost core 12 is correspondingly positioned in a defined position relative to the model blank 20.

Figure 6:
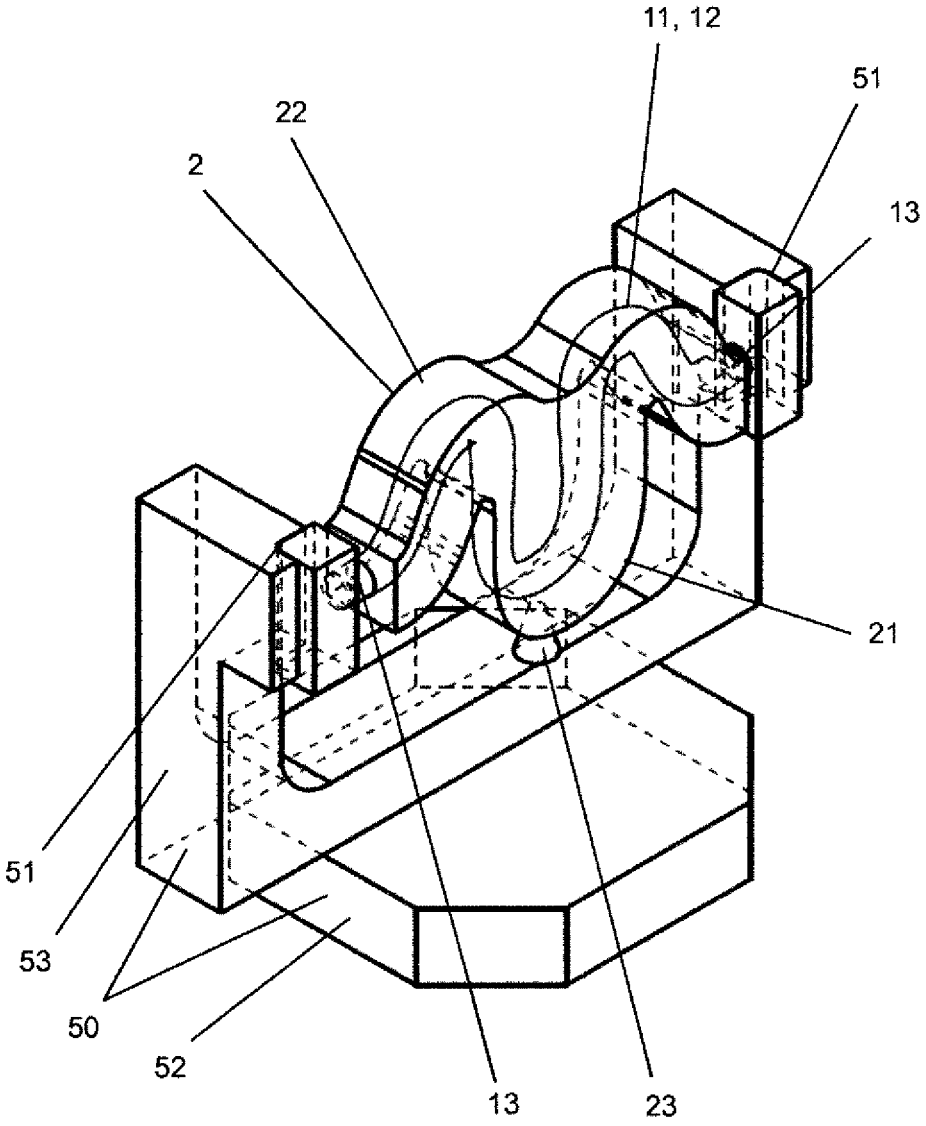
FIG. 6 shows a lost core on a processing mount, wherein the lost core is arranged in a lost model.

The cubatures of the model blank 20 and of the tool cavity 35 are each greater than a lost model 21 to be produced therefrom (see FIG. 6).

After the model molding tool 30 is removed according to the method state as per FIG. 4, the arrangement as per FIG. 5 remains. The manner in which the core element 11 with the lost core 12 is also fixed to the processing mount 50 via the fixing 51 can be seen in FIG. 5. Now, however, the lost core 12 is arranged additionally in the model blank 20 composed of the modelling material. The result of this is a model mold core blank 1. In a manner corresponding to the model sprue 34 of the model molding tool 30, a manufacturing-related sprue point 24 also still remains on the model blank 20.

Using a corresponding cutout in the tool cavity 35, a conical sprue model 23 is also formed, as can be seen through the model blank 20.

In order to arrive at the state as per FIG. 6 from that of FIG. 5, it is necessary to produce an outer contour 22 of the lost model 21 from the model blank 20, this being carried out in accordance with the 3D model in a second CNC production process, while the fixing 51 continues to persist. For this purpose, the processing mount 50 with the coupling piece 52 can be fixed again in a CNC machine for carrying out the second CNC production process, after said production mount has been positioned. This is achieved particularly easily by using a zero point fixing system. According to the method, the lost core 12 thus still assumes a defined position on the processing mount 50 and consequently the lost model 21 is also positioned correctly relative to the processing mount 50 and thus also to the lost core 12. The lost core 12 forms together with the lost model 21 a model mold core 2.

The second CNC production process is a material-removing process, wherein preferably a machining process, and particularly preferably a milling process, are used.

As an alternative, should the model blank 20 as a whole or in part have a smaller cubature than the later lost model 21, the outer contour 22 of the lost model 21 in these regions should be produced by a material-depositing process, for example in a (CNC) 3D printing process.

Figure 7:
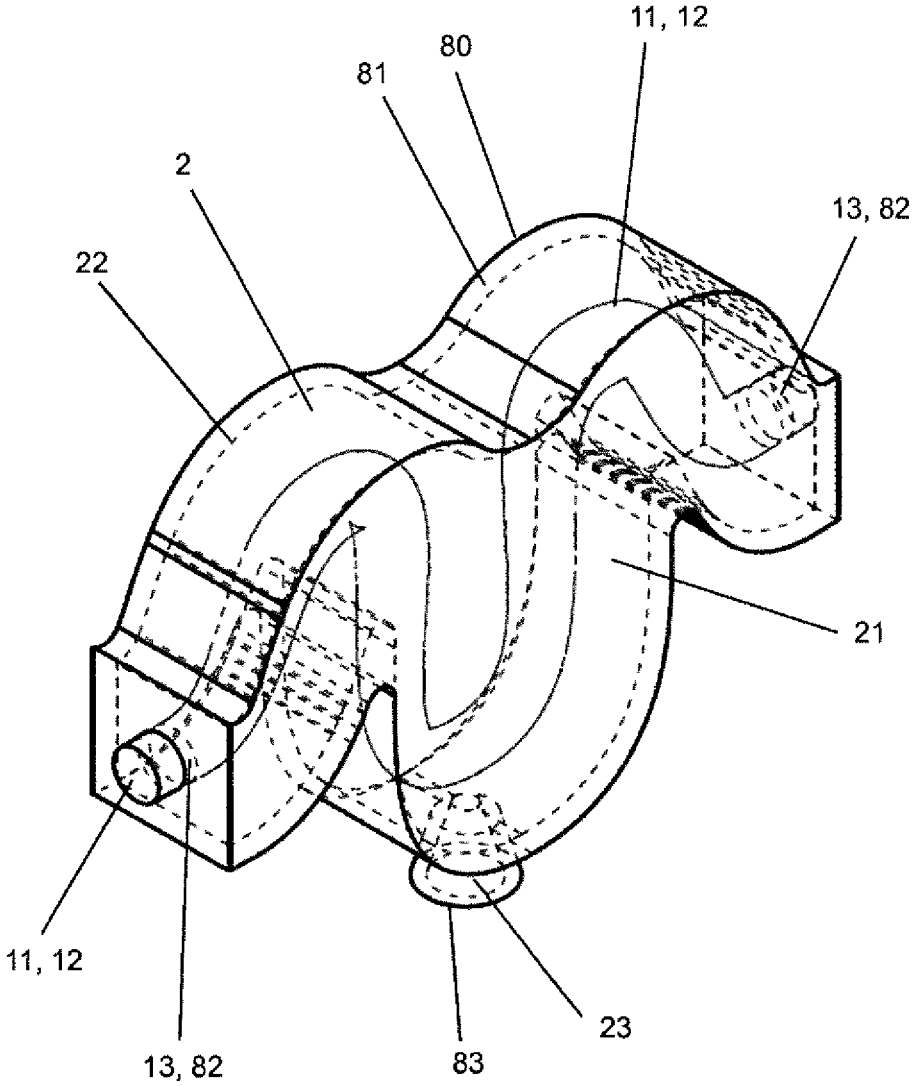
FIG. 7 shows a lost model and a lost core which are enveloped by a ceramic mold of a precision casting mold.

The model mold core 2, specifically the lost model 21 and the lost core 12 arranged therein, can now be separated from the processing mount 50, because the aim of arranging the lost core 12 exactly in the lost model 21 is achieved and is not negatively influenced in the next steps. As can be seen in FIG. 7, the fixing 51 is in particular removed by separating the lost core 12 from the fixing region. Here, the fixing region can remain on the processing mount 50. The fixing region can be removed from said processing mount later as required.

FIG. 7 also shows how the lost model 21 and the lost core 12 are enveloped by a ceramic mold 81 of a precision casting mold 80. Only the ends of the lost core 12 still protrude from the ceramic mold 81. For this purpose, according to the method, the ceramic mold 81 has been applied to the outer contour 22 of the lost model 21. The ceramic mold 81 can be applied to the outer contour 22 of the lost model 21 for example by virtue of repeated immersion into a ceramic slip, wherein, after each immersion, excess slip flows off and sanding with ceramic stucco and air drying take place. In this way, a plurality of ceramic layers which form the ceramic mold 81 on the outer contour 22 in the manner of a mold shell can be built up. Provision is made here according to the method that a positioning connection 82 of the ceramic mold 81 to the two attachment points 13 is produced on the core element 11, with the result that the lost core 12 is fixedly connected to the ceramic mold 81. For this purpose, the lost core 12 protrudes with the attachment points 13 out of the lost model 21. The model mold core 2 can be held during the production of the ceramic mold 81 at these protrusions, wherein the attachment points 13 should be kept clear.

Before applying the ceramic mold 81, sprue and/or ventilation structural parts can optionally be attached to the lost model 21. These structural parts are then connected to the ceramic mold 81 preferably when it is being applied.

It can be seen that, using the sprue model 23, a sprue 83 which is part of the ceramic mold 81 has also been formed.

The lost model 21 can now be removed from the ceramic mold 81, for example by being melted out, wherein the molten modelling material can drain through the sprue 83. For this purpose, the arrangement as per FIG. 7 can be fed for example to a steam autoclave in order to remove the lost model 21. The ceramic mold 81 with the lost core 12 arranged therein remains as precision casting mold 80.

Where the precision casting mold 80 is not yet sufficiently stable for the subsequent method steps, it can firstly be fired.

As soon as the precision casting mold 80 is finished, the casting process can be prepared and carried out. The preparation usually includes a change of work area and positioning in a casting device. The precision casting mold 80 is optionally preheated before the casting. According to the method, what follows is molten metal being cast through the sprue 83 into the ceramic mold 81 and around the lost core 12. The molten metal can be, for example, a titanium-based, nickel-based or cobalt-based alloy. After the metal melt has solidified to form a solid component 102 (see FIG. 8), the ceramic mold 81 and the lost core 12 can be removed from the solid component 102, in particular in a destructive manner. The ceramic mold is typically broken open and/or milled open. The lost core 12 can be dissolved for example by chemical reactions, for example dissolved in water or dissolved in another way, and then runs out of the remaining void structures 101 in the solid component 102.

Figure 8:
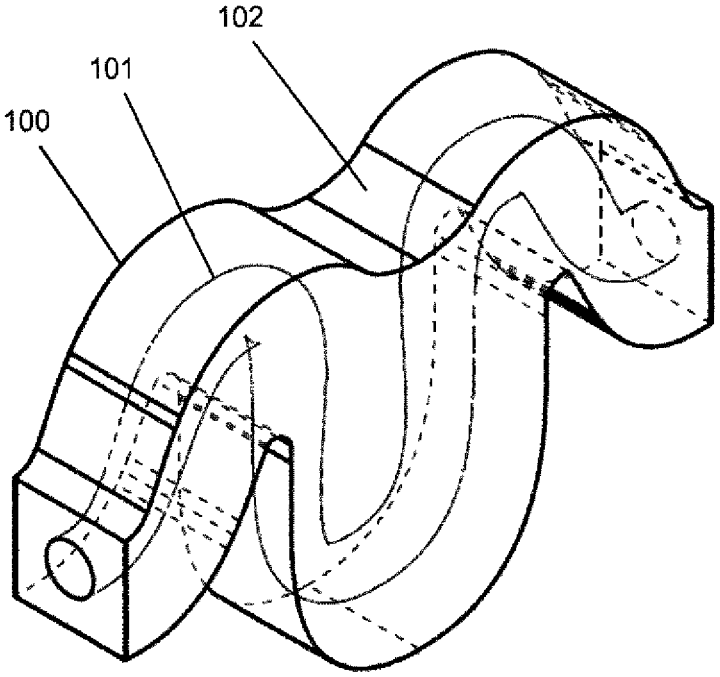
FIG. 8 shows a cast part with a solid component and a void structure.

A cast part 100 usually remains, as shown in FIG. 8, and comprises a solid component 102 as well as a void structure 101 in the solid component 102. According to the method, the lost model 21 is thus a positive model of the cast part 100 and the lost core 12 is a model of the void structure 101.

The geometries to be created in the production processes, in particular of the lost core 12 and the lost model 21, are based on the geometrical data of the later cast part 100. The geometries to be created can be determined by using a 3D model with the digital geometrical coordinates of the cast part 100. If necessary, the geometries to be created are adapted with respect to the digital geometrical coordinates of the cast part 100. In this way, shrinkage, component stresses and the like can be taken into consideration in order to finally obtain a physical cast part 100, the form of which corresponds to the 3D model with the digital geometrical coordinates of the cast part 100.

The invention is not restricted to one of the embodiments described above, but can be modified in a wide variety of ways.

In a different variant, it is possible for example to retain a stabilizing frame 15 having supporting points 16 by way of the method state as per FIG. 2. The stabilizing frame 15 can then support the lost core 12 also during the production of the model blank 20 and optionally also during the production of the lost model 21. In this respect, the stabilizing frame 15 can be arranged at least partially in the model blank 20. Said stabilizing frame can, however, also lie at least partially outside the model blank 20. However, the stabilizing frame 15 should be arranged outside the lost model 21. Supporting points 16 of the stabilizing frame 15 can then protrude through the lost model 21 as far as the lost core 12. In this way, even lost cores 12 with an unstable configuration are stabilized during the further method steps.

The alternative of adding a fully or partially smaller model blank 20 to the outer contour 22 of the lost model 21 by a material-depositing process such as 3D printing has already been mentioned.

All of the features and advantages, including structural details, spatial arrangements and method steps, arising from the claims, the description and the drawing may be essential to the invention, both individually and in a wide variety of combinations.

LIST OF REFERENCE SIGNS

| | |
|---|---|
| 1 | Model mold core blank |
| 2 | Model mold core |
| 10 | Ceramic blank |
| 11 | Core element |
| 12 | Lost core |
| 13 | Attachment point |
| 15 | Stabilizing frame |
| 16 | Supporting point |
| 20 | Model blank |
| 21 | Lost model |
| 22 | Outer contour |
| 23 | Sprue model |
| 24 | Sprue point |
| 30 | Model molding tool |
| 31 | First mold half |
| 32 | Second mold half |
| 33 | Positioning surface |
| 34 | Model sprue |
| 35 | Tool cavity |
| 50 | Processing mount |
| 51 | Fixing |
| 52 | Coupling piece |

-continued

| | |
|---|---|
| 53 | Processing bridge |
| 80 | Precision casting mold |
| 81 | Ceramic mold |
| 82 | Positioning connection |
| 83 | Sprue |
| 100 | Cast part |
| 101 | Void structure |
| 102 | Solid component |

The invention claimed is:

1. A method for producing a model mold core blank (1), which is suitable for producing a cast part (100) having a void structure (101), using a 3D model with digital geometrical coordinates of the cast part (100), comprising the following steps:

a) positioning a ceramic blank (10) on a processing mount (50) and producing a fixing (51) between the ceramic blank (10) and the processing mount (50);

b) producing a core element (11), by manufacturing a lost core (12) from the ceramic blank (10) on the basis of the 3D model of the cast part (100) in a first CNC production process during the fixing (51) of step (a), wherein the processing mount (50) is fixed in a CNC machine for carrying out the first CNC production process;

producing a stabilizing frame (15) from the ceramic blank (10) during the first CNC production process and during the fixing (51) of step (a), the stabilizing frame (15) supporting the lost core (12) manufactured from the same ceramic blank; and c) producing a model blank (20) by casting modelling material around the lost core (12) and allowing the modelling material to solidify during the fixing (51) of step (a).

2. The method as claimed in claim 1, comprising the following step:

positioning the processing mount (50) before carrying out the first CNC production process and before the processing mount (50) is fixed in the CNC machine carrying out the process.

3. The method as claimed in claim 1, wherein the processing mount (50) has a coupling piece (52) for accommodation in a zero point fixing system, and wherein, when carrying out the first CNC production process, the coupling piece (52) is accommodated in a zero point fixing system of the CNC machine carrying out the process.

4. The method as claimed in claim 1, comprising the following step:

removing one or more supporting points (16) between the stabilizing frame (15) and the lost core (12) after production of the lost core (12) and before producing the model blank (20).

5. The method as claimed in claim 1, comprising the following step:

removing the stabilizing frame (15) after production of the lost core (12) and before producing the model blank (20).

6. The method as claimed in claim 1, comprising the following step:

forming a sprue model (23) during production of the model blank (20).

7. The method as claimed in claim 1, wherein the 3D model with the digital geometrical coordinates of the cast part is optionally adapted in order to take into consideration a correction of manufacturing-related dimensional deviations due to shrinkage or material stresses.

8. A method for producing a precision casting mold (80), in which the following steps are carried out:

A) carrying out a method for producing a model mold core (2), in which the following steps are carried out:

a. a method for producing a model mold core blank (1), which is suitable for producing a cast part (100) having a void structure (101), using a 3D model with digital geometrical coordinates of the cast part (100), comprising the following steps:

i) positioning a ceramic blank (10) on a processing mount (50) and producing a fixing (51) between the ceramic blank (10) and the processing mount (50);

ii) producing a core element (11), wherein a lost core (12) is manufactured from the ceramic blank (10) on the basis of the 3D model in a first CNC production process during the fixing (51) of step a)(i), wherein the processing mount (50) is fixed in a CNC machine for carrying out the first CNC production process;

iii) producing a model blank (20) by casting modelling material around the lost core (12) and allowing the modelling material to solidify during the fixing (51) of step a)(i);

b. producing a lost model (21) with an outer contour (22) from the model blank (20) on the basis of the 3D model in a second CNC production process during the fixing (51) of step a)(i), wherein the processing mount (50) is fixed in a CNC machine for carrying out the second CNC production process;

B) applying a ceramic mold (81) to the outer contour (22) of the lost model (21) and forming a positioning connection (82) of the ceramic mold (81) to at least one attachment point (13) on the core element (11), wherein the processing mount (50) does not have any direct connection to the ceramic mold (81); and C) removing the lost model (21) from the ceramic mold (81).

9. The method as claimed in claim 8, comprising the following step:

positioning the processing mount (50) before carrying out the second CNC production process and before the processing mount (50) is fixed in the CNC machine carrying out the process.

10. The method as claimed in claim 9, wherein the processing mount (50) has a coupling piece (52) for accommodation in a zero point fixing system, and wherein, when carrying out the second CNC production process, the coupling piece (52) is accommodated in a zero point fixing system of the CNC machine carrying out the process.

11. The method as claimed in claim 8, wherein the processing mount (50) has a coupling piece (52) for accommodation in a zero point fixing system, and wherein, when carrying out the second CNC production process, the coupling piece (52) is accommodated in a zero point fixing system of the CNC machine carrying out the process.

12. The method as claimed in claim 8, wherein a sprue model (23) is formed during the producing of the lost model (21) with the outer contour (22) from the model blank (20).

13. The method as claimed in claim 8, wherein the following step is carried out:

removing the fixing (51) between the processing mount (50) and the core element (11) and separating the core element (11) from the processing mount (50) before or after removing the lost model (21) from the ceramic mold (81).

14. The method as claimed in claim 13, wherein the following step is carried out:

firing an arrangement comprising the core element (11) and the ceramic mold (81) after separating the core element (11) from the processing mount (50).

15. The method as claimed in claim 8, comprising the following step:

producing a stabilizing frame (15) from the ceramic blank (10) during the first CNC production process and during the fixing (51) of step a)(i), wherein the stabilizing frame (15) supports the lost core (12).

16. The method as claimed in claim 15, comprising the following step:

removing one or more supporting points (16) between the stabilizing frame (15) and the lost core (12) after production of the lost core (12) and before producing the model blank (20).

17. The method as claimed in claim 15, comprising the following step:

removing the stabilizing frame (15) after production of the lost core (12) and before producing the model blank (20).

18. The method as claimed in claim 8, comprising the following step:

positioning the processing mount (50) before carrying out the first CNC production process and before the processing mount (50) is fixed in the CNC machine carrying out the process.

19. The method as claimed in claim 8, wherein the processing mount (50) has a coupling piece (52) for accommodation in a zero point fixing system, and wherein, when carrying out the first CNC production process, the coupling piece (52) is accommodated in a zero point fixing system of the CNC machine carrying out the process.

20. The method as claimed in claim 8, comprising the following step:

forming a sprue model (23) during production of the model blank (20).

21. A casting method for producing a cast part (100) having a void structure (101), in which the following steps are carried out:

i.a) carrying out the method for producing a precision casting mold (80) as claimed in claim 8;

ii) casting molten metal into the ceramic mold (81) around the lost core (12);

iii) solidifying the molten metal to form a solid component (102);

iv) removing the ceramic mold (81) and the lost core (12) from the solid component (102).

22. The method as claimed in claim 21, wherein the following step is carried out:

i.b) removing the fixing (51) between the processing mount (50) and the core element (11) and separating the core element (11) from the processing mount (50) no later than before the molten metal is cast into the ceramic mold (81).

* * * * *